US005947300A

United States Patent [19]

Lange

[11] Patent Number: 5,947,300

[45] **Date of Patent: *Sep. 7, 1999**

[54] CYCLONE SEPARATER HAVING SWITCHABLE INLET

[76] Inventor: Neville E. Lange, 88 Elmbridge Road, Gloucester, United Kingdom, GL2 0PB

[ * ] Notice: This patent issued on a continued prosecution application filed under 37 CFR 1.53(d), and is subject to the twenty year patent term provisions of 35 U.S.C. 154(a)(2).

[21] Appl. No.: 08/564,158

[22] PCT Filed: Jun. 30, 1994

[86] PCT No.: PCT/GB94/01419

§ 371 Date: Dec. 21, 1995

§ 102(e) Date: Dec. 21, 1995

[87] PCT Pub. No.: WO95/01224

PCT Pub. Date: Jan. 12, 1995

[30] Foreign Application Priority Data

Jul. 1, 1993 [GB] United Kingdom ..... 9313614

[51] Int. Cl.[6] ..... B04C 11/00

[52] U.S. Cl. ..... 209/726; 209/717; 209/729; 209/734; 210/512.2

[58] Field of Search ..... 209/710, 711, 209/712, 715, 717, 718, 719, 725, 727, 728, 729, 734, 726; 210/512.1, 512.2

[56] References Cited

U.S. PATENT DOCUMENTS

| | | | |
|---|---|---|---|
| 2,377,721 | 6/1945 | Scott | 209/734 X |
| 3,516,551 | 6/1970 | Wallen et al. | 209/734 X |
| 4,225,325 | 9/1980 | Diehl et al. | 55/418 X |

FOREIGN PATENT DOCUMENTS

| | | | |
|---|---|---|---|
| 1217487 | 3/1986 | U.S.S.R. | 209/734 |
| 499441 | 2/1938 | United Kingdom . | |
| 1185274 | 6/1968 | United Kingdom . | |

*Primary Examiner*—Tuan N. Nguyen
*Attorney, Agent, or Firm*—Nixon & Vanderhye P.C.

[57] ABSTRACT

A separation apparatus for separating a mixture of materials including a cyclone having an inlet capable of being switched into either one of two conditions, such as fully closed and fully or pre-set partially open, by movement of at least part of the cyclone. A plurality of cyclones may be provided enclosed in a pressure vessel.

21 Claims, 7 Drawing Sheets

CYCLONE SEPARATER HAVING SWITCHABLE INLET

BACKGROUND OF THE INVENTION

1. Field of the Invention

This invention relates to separation apparatus used for separating materials such as solid particles (e.g. dust and dirt) from a fluid (e.g. air or water) or one liquid (e.g. oil) from another (e.g. produced water). The mixture of materials to be separated is fed tangentially at a high rate into an inlet of at least one cyclone incorporated in the apparatus, and after separation passes out through one of two outlets known as the underflow outlet and overflow outlet respectively.

2. Discussion of Prior Art

Naval Technical Bulletin Disclosure Volume 4 No 12 December 1979 at pages 21–25 discloses a centrifugal fuel filtering device including a cyclone into which supply fuel is injected at a regulated tangential velocity by a differential pressure-responsive piston. A vortex is established within the cyclone thereby concentrating heavier contaminated fuel at the outer cyclone radius and lighter clean fuel at an inner radius about a screen through which the clean fuel is extracted.

It is known that when fluid flows through a cyclone, the pressure differential across the cyclone is related to the flow rate by the approximate equation $$P \sim Kq^n \quad (1)$$

where

P=pressure differential q=flow rate

K=a constant n=a number between 2 and 3

K and n are dependent on the geometry of the cyclone. It can be seen therefore that increasing the flow rate q causes an increased pressure differential P.

A cyclone is normally operated so that the pressure differential from the inlet to the overflow outlet is the same as, or is a constant ratio of, the pressure differential from the inlet to the underflow outlet. In cyclones for separating solids from liquids these pressure differentials are normally equal, and the pressure differentials are maintained by discharging material through both the underflow and overflow outlets to atmospheric pressure. In cyclones for separating oil from produced water the pressure differential to the overflow outlet is typically twice the pressure differential to the underflow outlet and, because in this type of application the fluid flows often fluctuate, these pressure ratios are usually maintained by closed loop control systems.

It is generally desirable to operate a cyclone such that the pressure differential across the cyclone does not fall below a certain value (because for example efficiency may be reduced), or exceed a certain value (because for example wear rate becomes higher, pumping costs become higher, available pressure is exceeded, or in the case of liquid/liquid cyclones the efficiency may be reduced). For any given cyclone and application the pressure differential across the cyclone is related to the flow rate as indicated in the approximate equation (1) above. Other parameters do affect the pressure differential across the cyclone but their effects are generally insignificant in comparison to the effects of changes in flow rate. The desirable maximum and minimum operating pressure differentials can thus be equated to a maximum and minimum desirable flow rate per cyclone.

In order to keep a plurality of cyclones arranged in series or in parallel operating efficiently it is necessary to ensure that the flow rate through the or each cyclone is kept within a desirable range. Thus in a system which comprises a plurality of similar cyclones and which is subject to a varying flow rate, when the flow rate per cyclone exceeds the maximum desirable value the flow must be divided through a larger number of cyclones and when the flow rate per cyclone is less than the minimal desirable value the flow must be divided through a smaller number of cyclones. If each of said cyclones has a valve fitted to one or more of its ports, then increasing or decreasing the number of cyclones through which the flow is divided is simply a matter of operating the appropriate valves, and this may be accomplished without stopping or limiting the flow. If said cyclones are contained within a pressure vessel and are not individually valved, then either a plurality of vessels each containing different numbers of cyclones is necessary, combinations of these vessels being used over a certain fraction of the total flow range, or the vessel must be opened and the number of operating cyclones it contains altered. If stoppages in the flow cannot be accepted, then to alter the number of cyclones in a vessel will require a second vessel through which the flow can be passed while the number of cyclones in the first vessel is altered.

SUMMARY OF THE INVENTION

It is an object of the present invention to provide an apparatus wherein the aforementioned disadvantages are substantially reduced or overcome.

In accordance with the invention separation apparatus for separating a mixture of materials which is a fluid or behaves as a fluid, comprises a vessel containing a plurality of cyclones, each cyclone having an inlet, an overflow outlet and an underflow cutlet, characterised in that the cyclones are arranged in grows, and the inlet of the or each cyclone in a group is capable of being switched between open and closed conditions by movement of at least part of a cyclone in a direction parallel to the axis thereof.

The said movement is preferably caused by changing the differential pressure between the inlet and at least one of the outlets thereof, the pressure differential which causes switching of the or each cyclone in a group being different from the differential pressure which causes switching of the or each cyclone in another group.

Pressure applying means, located externally of the cyclone, may be provided to cause said movement.

In the apparatus, axial motion of the cyclone in relation to other fixed components or axial motion of components relative to a fixed cyclone may be used to open or close at least one of the cyclone inlet and outlets and thus effectively switch a particular cyclone or group of cyclones into or out of operation. However, instead of using a linear motion, components or cyclones which rove in a rotational or helical motion may be used to open or close at least one of the cyclone inlet and outlets and again switch a cyclone into or out of operation.

A check valve may be connected to one of the overflow outlet and the underflow outlet, said check valve being combined with a valve connected to the inlet.

Fluid flowing through the cyclone generates the pressure differential to which may be used to cause the cyclone to switch to an open condition at high pressure and to switch to a closed position at low pressure. However the converse situation is also possible insofar as the cyclone may be caused to switch to a closed position at high pressure and switch to open at a low pressure.

The differential pressure generated by the flow through the cyclone may act directly on the or each movable part of the cyclone or associated component to cause a linear, rotational or helical motion.

A spring device exhibiting a negative spring rate which produces a force in opposition to the pressure and friction forces in the cyclone may be used to ensure that the cyclone inlet or outlets will only be fully open or fully closed in normal operation and that an unstable situation as described herein will not occur.

The pressure vessel may contain cyclones capable of being switched between open and closed conditions and also contain one or more cyclones without such a capability. The number of cyclones in each category is chosen to prevent the situation occurring where the switching of a cyclone (or group of cyclones) between the open and closed conditions causes a change in flow rate per cyclone that is greater than the desirable range of flow rate per cyclone.

The two categories of cyclone may be enclosed in two or more vessels connected together so as to operate in parallel.

The cyclones in a pressure vessel may be of a type wherein the said movement causes a change in the cross-sectional area of the inlet rather than a sudden change between fully closed (0%) and fully open (100%). The change in cross-sectional area may be utilised in different ways.

For example the inlet area of a particular cyclone, or each cyclone in a group of cyclones, may be switched from 100% open to, say, 60% open and nowhere in between. As a result, the flow rate of the or each cyclone may change from 100% to 30% (and nowhere in between). However the limitation of this is that the vessel containing exclusively cyclones of this type may not be able to have as much turn-down as is possible with cyclones which switch between the fully closed (0%) and finally open (100%) conditions. It is possible to have both types combined in the same vessel to overcome this limitation and, in some instances, provide greater turn-down than is possible with either type used exclusively.

In another example the inlet area of the or each cyclone in the vessel may be continuously variable thus giving a continuously variable flow rate between 100% and, say, 30%. All, or a particular group of cyclones, in the vessel may be controlled in this way, and the vessel may include at least one group which switches only to fully open (100%) or fully closed (0%) condition and at least one group which does not switch at all.

Preferably the apparatus comprises means for applying a controlling pressure to the apparatus, the said movement being controlled thereby. The motion of the movable pars of cyclones or associated components may be controlled by the application of the controlling pressure to the apparatus.

Further, by varying the areas of the movable components e.g. head pistons, on which the controlling pressure acts, it is possible to produce two or more cyclones which when operating under the same differential pressure will switch between the open and closed positions at a different applied controlling pressure.

To control the controlling pressure a control system e.g. a pilot valve, may be located internally or externally of the apparatus e.g. the vessel, the control system being of a type such that it produces only a high or low controlling pressure, such as to cause the closure of the cyclone ports at low cyclone differential pressure and the opening of the cyclone ports at a high cyclone differential pressure. The control system may also be of a type that produces a sufficient controlling pressure to operate a number of cyclones simultaneously. Alternatively, a control system which produces an infinitely variable controlling pressure in response to the cyclone differential pressure may be used preferably in conjunction with cyclones which switch between the open and closed positions at different controlling pressures so as to vary the number of cyclones in the open and closed positions with a single controlling pressure. The apparatus may comprise a plurality of cyclones arranges in more than one group, each group having associated therewith a control system providing sufficient controlling pressure to operate each cyclone in that group.

A flow measuring system may be provided to generate an input signal for the control system, or the input signal may represent the desired flow rate through the apparatus (and thus use the apparatus as a form of control valve). A control device that is intended to control the properties of the fluids processed by the cyclone e.g. oil in water content of the underflow, may also be used to generate the input signal.

An analyser may be provided which measures a property of the fluid processed by the cyclone, (which property may be influenced by the cyclone) said analyser generating a signal which operates the control system e.g. causing the number of cyclones in use to be changed. For example, the analyser may measure the concentration of oil in water which has been processed, and on measuring an increase in oil concentration generates a signal which causes the control system to reduce the number of cyclones which are on-line, so as to increase the flow rate through each cyclone, thereby increasing their efficiency i.e. increasing the amount of oil separated, so as to reduce the concentration of oil in the processed water. In this example the control system may also have to switch on-line one of more pumps to overcome the increased pressure differential through the or each cyclone due to the increased flow rate.

As stated above there may be axial motion of components relative to a fixed cyclone or axial motion of a cyclone relative to fixed components and these may be caused by the control system. Either of these axial motions may be used to cause a variation in the velocity of the fluid entering the cyclone inlet port by varying the cross-sectional area of the inlet port and thus varying the operation of the cyclone.

The differential pressure created by the fluid flow may be caused to act directly on the movable components to produce required motions of the parts, to cause the variation of the inlet fluid velocity.

In some embodiments of the invention the spring devices which are used to enable the cyclone ports to be fully open or fully closed will need to exhibit negative spring rates. However it is possible to use a spring device that exhibits a positive spring rate so as to produce, in conjunction with the pressure and frictional forces referred to above, the variation in the inlet port cross-sectional area that has a desired relationship to the differential pressure across the cyclone.

BRIEF DESCRIPTION OF THE DRAWINGS

Six embodiments of the invention, each a separation apparatus for separating oil from produced water, will now described by way of example only with reference to the accompanying drawings FIGS. 1 to 6, each of which shows a longitudinal cross-section through separation apparatus in accordance with the invention.

DETAILED DESCRIPTION OF PREFERRED EMBODIMENTS

Figure 1:
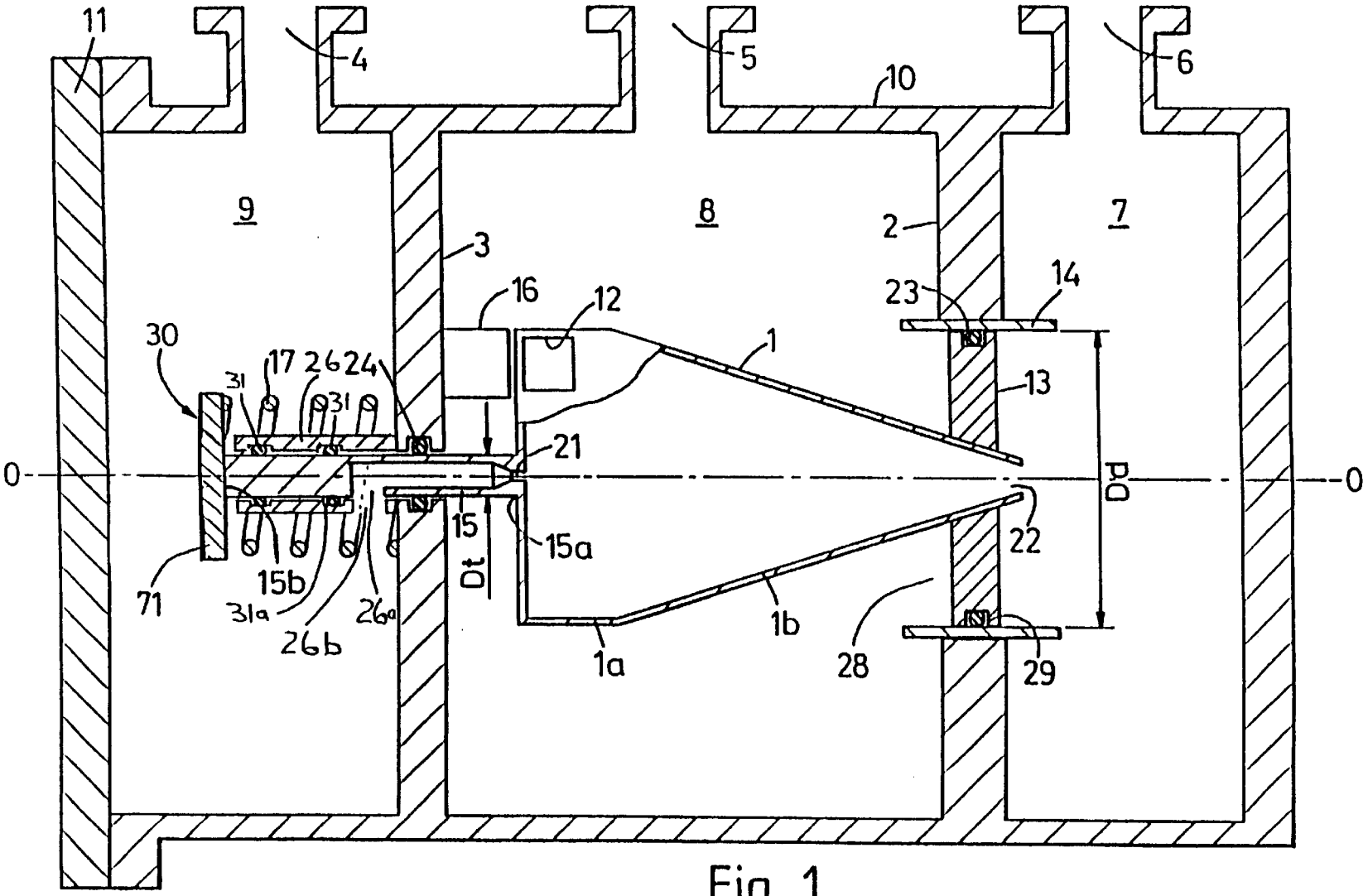

The embodiment shown in FIG. 1 comprises a pressure vessel 10 within which is housed a plurality of cyclones 1.

Figure 7:
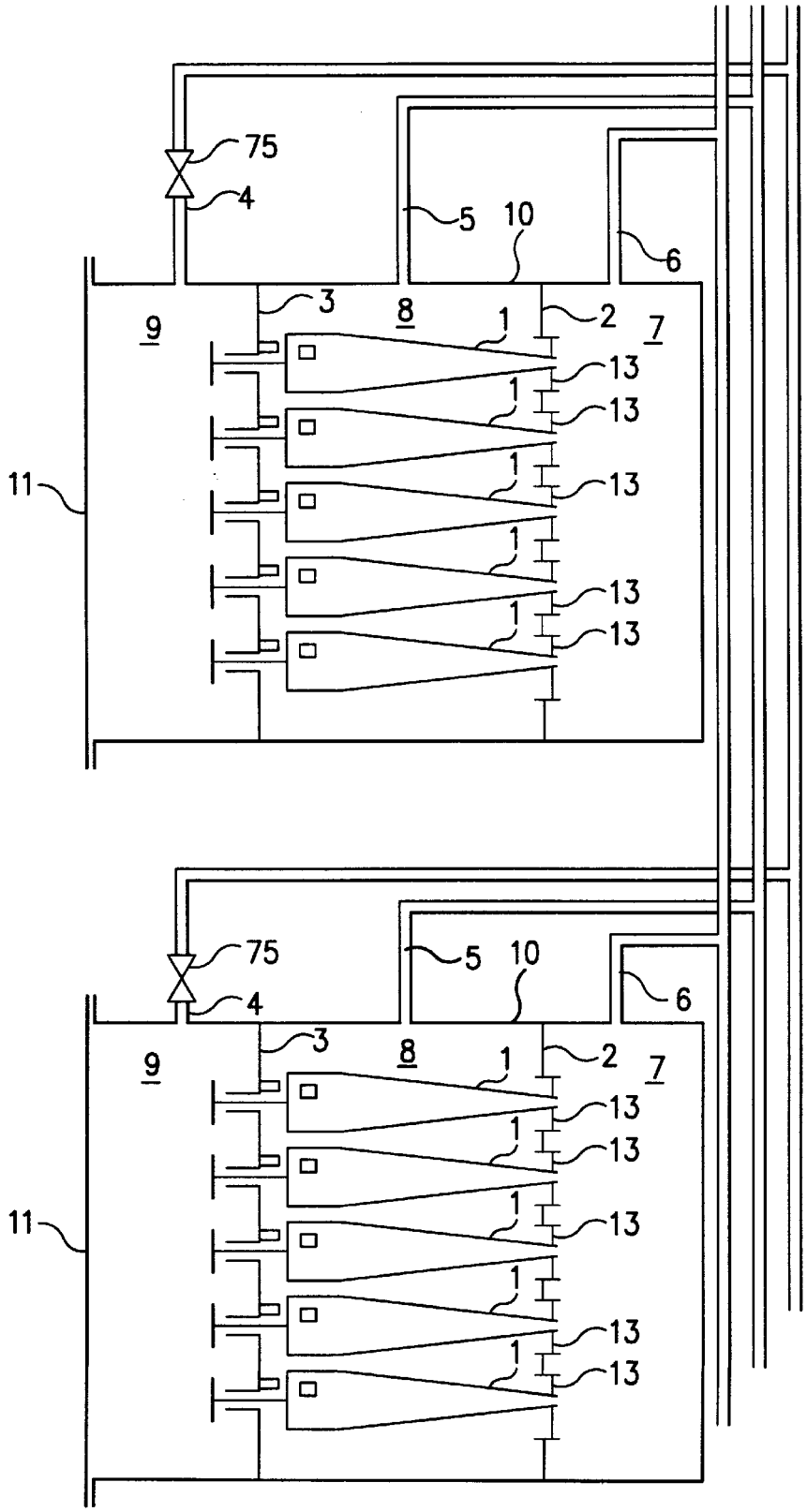
FIG. 7 shows in simplified form two vessels connected to operate in parallel, each vessel containing five cyclones of the kind shown in FIG. 1. A cyclone of simple form is shown in these embodiments for clarity. Cyclones of more complex geometries may equally well be used.

For clarity only one pressure vessel and one cyclone is shown in FIG. 1. Two pressure vessels 10, connected to operate in parallel, and each containing a plurality of cyclones 1 (five cyclones shown in each vessel) are shown in FIG. 7. Each cyclone has a cylindrical portion 1*a* and a tapered portion 1*b*. The housing is closed by an end plate 11.

The cyclone 1 is supported in the vessel 10 by two walls in the form of tubeplates 2 and 3, which divide the interior of the vessel to form three chambers: an inlet chamber 8 which the mixture of oil and water to be separated enters via a vessel inlet nozzle 5, an underflow chamber 7 from which water and a smaller proportion of oil than in the mixture fed through the inlet exits via a vessel underflow nozzle 6 and an overflow chamber 9 from which water and a larger proportion of oil exits via a vessel overflow nozzle 4 provided with a check valve 75. In this embodiment the cyclone 1 has one inlet port 12 tangentially disposed in the cylindrical portion 1*a*, (although more than one inlet port may be provided) an underflow port 22 at the end of the tapered portion 1*b* and an overflow port 21, each of which opens into the inlet chamber 8, the underflow chamber 7 and the overflow chamber 9 respectively.

The tubeplate 2 is formed with a circular aperture 28 around the edge of which is provided a cylindrical ring 14 having an internal diameter $D_d$ and corresponding cross-sectional area $A_d$. A circular disc 13 fits within the ring, the disc being provided with a peripheral groove 29 retaining an O-ring or other type of seal 23 which engages the interior surface of the cylindrical ring 14. The disc 13 is provided with a central aperture within which is secured the tapered part 1*b* of the cyclone 1.

As shown in FIG. 1 an elongated tube 15 is attached at one end 15*a* to the cyclone to surround the overflow outlet port 21 which is centrally located on a longitudinal axis of the cyclone, the tube 15 extending coaxially away from the cyclone. The tube 15 has an external diameter $D_t$(corresponding cross-sectional area $A_t$) and passes through an aperture in the tubeplate 3 and is sealed by an O-ring 24 in a groove surrounding the tube.

This construction and arrangement allows the cyclone to move axially (within limits) when an appropriate force is applied, the disc 13 acting as a piston within the cylindrical ring 14 and the seal 23 on the disc 13 and the seal 24 on the tube 15 providing effective sealing during this motion.

An inlet covering device 16 is attached to the tubeplate 3 which separates the inlet chamber 8 from the overflow chamber 9, and is positioned so that at one end of the axial motion of the cyclone 1 the inlet port 12 is covered and ingress of liquid to the cyclone is prevented, and at the opposite end of the axial motion of the cyclone 1 the inlet port 12 is completely uncovered, allowing unrestricted flow of liquid into the cyclone 1. The inlet port 12 is shown uncovered in FIG. 1. Thus the inlet flow rate is controlled so that it is either zero or a maximum value by the axial motion of the cyclone.

It is also possible to use the axial motion of the cyclone to control the opening or closing of the overflow port 21 or the underflow port 22, or any combination of three ports i.e. the inlet port 12, the overflow port 21 and the underflow port 22. FIG. 1 illustrates an arrangement whereby the opening or closing of the overflow port 21 is controlled by axial motion of the cyclone 1 in addition to the arrangement for controlling the opening or closing of the inlet port 12 described above.

The tube 15 extends rearwardly and passes through a further tube 26 fixed to the tubeplate 3, and is sealingly engaged by O ring seals 31 in grooves 31*a* formed on the interior surface of the further tube 26. The bore in the tube ends at an aperture 26*a*, which in the position shown in FIG. 1, is in juxtaposition to a further aperture 26*b* in the further tube 26. Secured to the end 15*b* of the tube further from the cyclone is a flange 71, the plane of which extends perpendicularly to the axis of the cyclone O—O. A spring device 17 e.g. a Belville washer, having a negative rate is positioned between the flange and the tubeplate 3 separating the inlet chamber 8 from the overflow outlet chamber 9.

As shown in FIG. 1 the aperture 26*a* is adjacent the aperture 26*b*. Thus the overflow port 21 is open allowing liquid to exit from the cyclone. When the cyclone moves axially (to the left as shown in FIG. 1) the tube 15 moves with it so that the aperture 26*a* moves to a position between the two seals 31 on the further tube, which is stationary, thus closing the overflow outlet port 21. When the cyclone has moved to close the inlet port 12 and the overflow port 21 the cyclone is effectively in an off-line condition.

The axial motion of the cyclone is caused by the interaction of forces produced by the pressure differential created by the liquid flowing through the cyclone, i.e. the liquid pressure acting on the disc 13 and the tube 15, the force of the spring device 17 and frictional forces.

It can be shown that the force F, due to the pressure of the liquid flowing through the apparatus and as shown in FIG. 1, pushing the cyclone to the right is given by the equations:

$$F=(P_i-P_u)(A_d-RA_t) \tag{2}$$

$$F=\frac{(P_i-P_o)(A_d-RA_t)}{R} \tag{3}$$

where $P_i$=Fluid pressure at cyclone inlet 12

$P_u$=Fluid pressure at cyclone underflow outlet 22

$P_0$=fluid pressure at cyclone overflow outlet 21

$A_d$=Cross-sectional area of disc 13

$A_t$=External cross-sectional area of tube 15

$$R=\frac{(P_i-P_o)}{(P_i-P_u)} \tag{4}$$

Since the areas $A_d$ and $A_t$, are fixed and the cyclone is operated so that R is constant, then $$F=C\ (P_i-P_0) \tag{5}$$

where C is a constant

Thus F varies in direct proportion to the pressure $(P_i-P_0)$ across the cyclone and since by definition $$(P_i-P_0)=P \tag{6}$$

it follows from equations (1) and (5) that $$F\approx K_2q^n \tag{7}$$

where $K_2$ is a constant

If $F_i$=the value of F corresponding to the minimum desirable pressure differential across the cyclone, $F_u$=the value of F corresponding to the maximum desirable pressure differential across the cyclone, $F_c$=the value of F at which the cyclone will move to its closed (left-hand) position, $F_c$ being greater than $F_i$ to provide a margin of certainty, and being different from the values of $F_c$ for other cyclones in the vessel, $F_0$ equals the value of F at which the cyclone will move to the open (right-hand) position, being a value less than $F_u$ to provide a margin of certainty, and being different from the values of $F_0$ for other cyclones in the vessel, by using the spring device 17 having a negative rate it is arranged that when the cyclone is in the closed (left-hand) position and F is greater than or equal to $F_0$ then the frictional forces and the force applied by the spring device 17 will be overcome and the cyclone will move to the open (right-hand) position and, when the cyclone is in the open (right-hand) position, and F is less than or equal to $F_c$, the frictional force and the force applied by the spring will be overcome and the cyclone will move to its closed (left-hand) position.

The use of a spring device 17 having a negative rate ensures that the cyclone is either in the open or closed positions, and does not stop at any intermediate position. In the action of closing, where the spring finally overcomes the pressure and frictional forces which hold the cyclone open, the negative spring rate causes the spring force to increase as the cyclone moves towards its closed position, thus increasing the net force on the cyclone, until it reaches a mechanical stop (not shown) in the closed position. Once closed the pressure must then rise to a higher value before the spring force will be overcome and begin to move the cyclone to the open position, and as the cyclone moves in that direction the negative spring rate causes the spring force to reduce, again increasing the net force on the cyclone. Thus the cyclone will not stop in an intermediate position.

Consider now a vessel containing many hydraulically similar cyclones, each operating efficiently within the same desirable pressure range. A proportion of these cyclones are constructed and arranged as shown in FIG. 1, through which passes liquids at a flow rate which rises from zero to a maximum value and then returns to zero.

1. When there is no flow the differential pressure across the cyclones is zero and hence F is less than $F_c$ and all cyclones as shown in FIG. 1 will have moved to their closed (left-hand) position.

2. As the incoming flow rate is increased, and while the flow rate per cyclone, for those cyclones not as shown in FIG. 1 but otherwise conventional, is less than the maximum desirable value, the differential pressure is less than the maximum desirable value, and F is not yet greater than $F_0$, so no cyclones as shown in FIG. 1 have switched to the open (right-hand) position.

3. As the incoming flow is increased further, and the flow rate per cyclone tends towards being greater than the maximum desirable value, the differential pressure across the cyclones rises towards the maximum desirable value, F becomes greater than $F_0$ for one of the cyclones as shown in FIG. 1, and that cyclone switches to the open position. The flow rate per cyclone is then decreased because the flow is now divided between the original cyclones plus one more and the differential pressure across all these cyclones is decreased further below the maximum desirable value. It must be ensured that the opening of this additional cyclone does not cause the flow rate per cyclone to drop below the flow rate corresponding to $F_c$ for any of the cyclones that are in the open position. If this occurs then that cyclone will switch to the closed position and another will switch to the open position, and on and on. The system may oscillate, and it will not be stable in operation.

4. As the incoming flow rate is further increased, stage 3 above is repeated i.e. further cyclones as shown in FIG. 1 switch to the open position.

5. As the incoming flow rate is decreased and the flow rate per cyclone tends towards being less than the minimum desirable value, the differential pressure across the cyclones falls towards the minimum desirable value, F becomes less than $F_c$ for one of the cyclones, and that cyclone switches to the closed position. The flow rate per cyclone is then increased because it is now divided between one fewer than the original number of cyclones and the differential pressure across these cyclones is increased further above the minimum desirable value. It must be ensured that the closing of this additional cyclone does not cause the flow rate per cyclone to rise above the flow rate corresponding to $F_0$ for any of the cyclones that are in the closed position. If this occurs then that cyclone will open and another will close, and on and on. The system may oscillate, and it will not be stable in operation.

6. As the incoming flow is further decreased, stage 5 is repeated until all cyclones as shown in FIG. 1 are switched to the closed position, and the flow is passing through the cyclones which are within the vessel but not as shown in FIG. 1.

The resulting effect is that a vessel containing cyclones as shown in FIG. 1 can switch cyclones to the open and closed positions to be able to follow flow fluctuations far greater than a vessel incorporating conventional cyclones i.e. not as shown in FIG. 1 could accept.

To ensure stability of operation the numbers of cyclones that may be switched to the open and closed positions may be defined as follows:

let

Q=flow rate per cyclone $Q_{max}$=maximum desirable flow rate per cyclone $Q_0$=flow rate per cyclone at which cyclones switch to an open condition $Q_c$=flow rate per cyclone at which cyclones switch to a closed position $Q_{min}$=minimum desirable flow rate per cyclone $N_0$=number of cyclones currently open (i.e. a whole number greater than or equal to 0)

$N_s$=increment or decrement to the number of cyclones in the open condition (i.e. a whole number greater than or equal to 1) thus to maintain the flow rate through the cyclone in the desirable range $$Q_{max} \geqq Q_0 > Q_c \geqq Q_{min} \tag{8}$$

and $$Q_0 \geqq Q \geqq Q_c \tag{9}$$

When the flow rate is increasing, to keep the cyclones operating within the desirable flow rate range, then $$N_s < N_0(Q_0 - 1) \tag{10}$$

and when the flow rate is decreasing then $$N_s < N_o\left(1 - \frac{Q_c}{Q_o}\right) \tag{11}$$

As the minimum number of cyclones that can be switched is one ($N_s$=1) then for given values of $Q_0$ and $Q_c$ there exists a minimum number of open cyclones $N_{min}$ in below which switching is not possible if the flow rate per cyclone is to be kept within $Q_0$ and $Q_c$. As the minimum number of cyclones that are in the open condition increases it may become possible to switch more than one cyclone.

Figure 2:
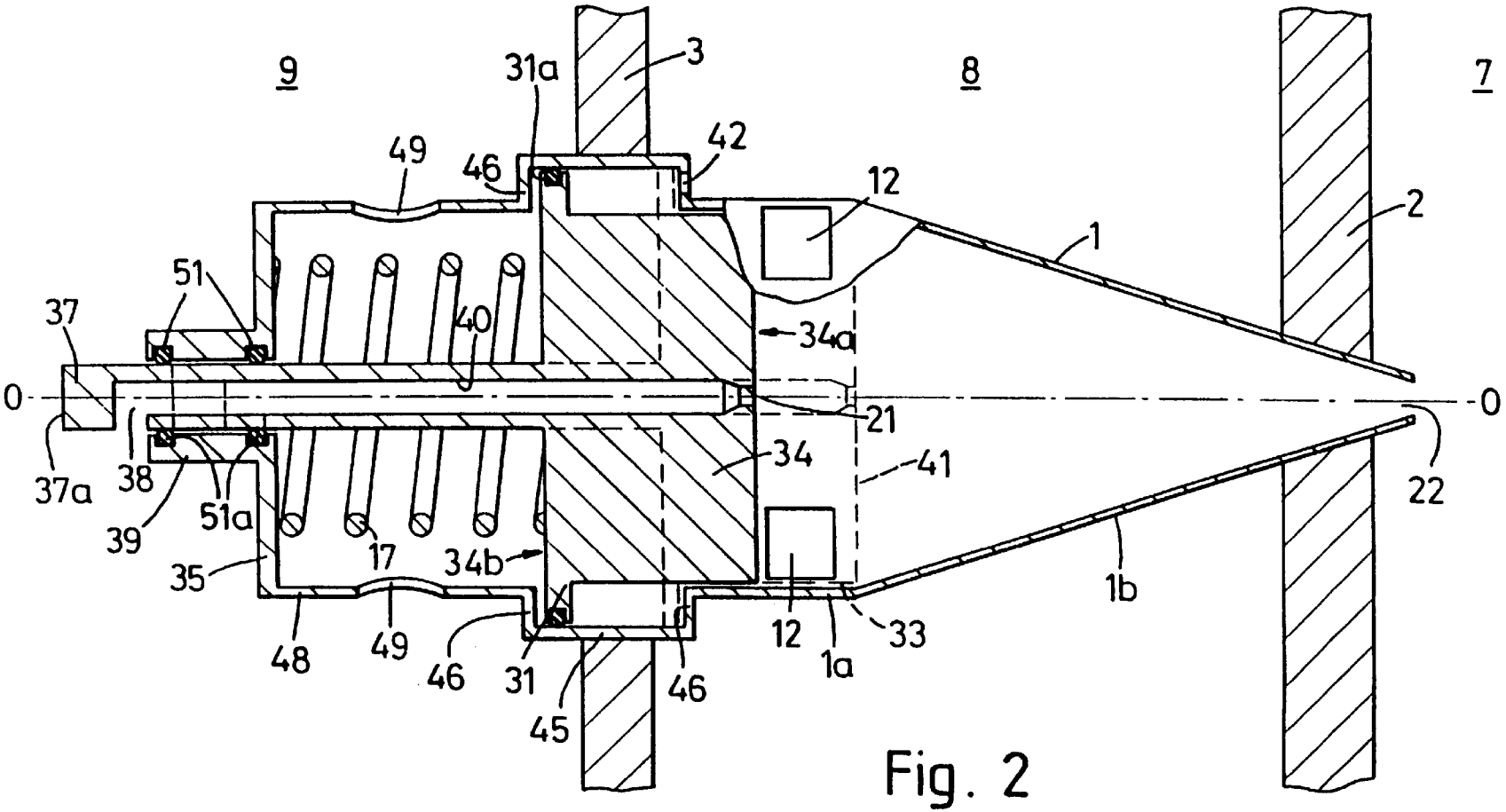

A second embodiment of the invention, in which the main body of each cyclone 1 remains stationary, is shown in FIG. 2. For clarity, in this FIG. 2, the outer walls of the vessel 10 have been omitted. As in the first embodiment the pressure vessel has two dividing walls in the form of tubeplates 2 and 3, dividing the vessel into three chambers 7, 8 and 9. The cyclone has an underflow port 22, an overflow port 21 and, in this embodiment, two inlet ports 12.

The end wall of the cyclone adjacent the inlet ports 12 is formed by one face 34*a* of a head piston 34. A flange 31 is formed adjacent the opposite, rear face 34*b* and extends around the periphery of the piston. A groove 31*a* containing an O-ring or other type of seal is provided at the peripheral edge of the flange to seal the piston to the body of the cyclone (although a known or controlled leakage may be acceptable). As can be seen in FIG. 2, the cyclone body has a section 45 of enlarged diameter where the cyclone is located within the tubeplate 3, the ends of this section providing stops 46 against which the flange 31 may abut to limit the axial movement of the head piston 34. An aperture 42 is provided in one end stop 46 connecting the enlarged section 45 with the inlet chamber 8. Thus the pressure of fluid within the inlet chamber 8 communicates to the cavity between the seal 31*a* and the end stop 46 via the aperture 42.

In the centre of the face 34*a* is the overflow outlet port 21 which communicates with the channel 40 positioned on the axis O—O of the cyclone. Extending from the rear face 34*b* of the head piston 34 i.e. opposite the face 34*a*, is a rearwardly-extending tube 37 positioned coaxially with the piston 34 and cyclone 1. The channel 40 extends through the tube 37. The end of the channel adjacent the port 21 is of reduced diameter and the end of the channel further from the head piston is blocked, but communicates with the exterior surface of the tube by a transversely-disposed exit port 38, near to but spaced apart from the tube end 37*a*.

As can be seen in FIG. 2 the cyclone body extends rearwardly from the section 45 of enlarged diameter. The end of the rearwardly-extending portion 48 is enclosed by a disc 35 having a cylindrical boss 39 at its centre through which the tube 37 extends. The interior of the boss 39 is provided with two spaced apart grooves 51 each containing an 0 ring seal 51*a* contacting the outer surface of the tube 37. A spring device 17 is located within the portion 48 pressing against the disc 35 and the rear face 34*b* of the head piston 34. The portion 48 communicates with the overflow chamber 9 by means of apertures 49.

As stated above the head piston 34 is able to move within limits as defined by the stops 46. The head piston is shown in full lines at one end of its motion (left-hand as shown) where it provides minimum obstruction to the fluid entering the cyclone by the inlet ports 12 and where flow through the exit port 38 is not obstructed. The head piston is shown in dashed lines (41) at the other end of its motion (right-hand as shown) where the head piston covers the inlet ports 12, preventing the flow of fluid into the cyclone. In this, closed, position the exit port 38 is closed by the seals 51*a* located in the boss 39.

It can be shown that the force F pushing the head piston to the open position i.e. the left-hand as shown in FIG. 2, is $$F = (P_i - P_o)\left(A_{pb} - \frac{A_{pa}}{R'}\right) \tag{12}$$

where $$R = \frac{(P_i - P_o)}{P_i - P_u} \tag{13}$$

$A_{pa}$=Cross-sectional area of face 34*a* of the head piston 34

$A_{pb}$=Cross-sectional area of rear face 34*b* of the head piston 34

When the cyclone is in its right-hand position as drawn R' is equal to R as defined in equation (13). When there is flow of fluid through the cyclone a radial pressure distribution is generated within the cyclone. The pressure at the centre of the cyclone is approximately equal to $P_u$ and at the inside surface of the cyclone at the position of the inlet port 12 the pressure is approximately equal to $P_i$ less the velocity head of fluid due to the velocity of the fluid in the inlet port. The average pressure acting on the area $A_{pa}$ thus lies between $P_i$ and $P_u$ and hence R' in the left-hand position is greater than R. $A_{pa}$ and $A_{pb}$ do not vary and the cyclone is operated so that R is constant. This means that R' in the left-hand position is almost constant so that if:

Fr is the pressure force when the piston is in the right hand position, and $F_1$ is the pressure force when the piston is in the left-hand position, then $$Fr=K_r(P_i-P_0) \tag{14}$$

and $$F_1=K_1(P_i-P_0) \tag{15}$$

where $K_r$=a constant and $K_1$=a constant (almost)

Thus the axial force is proportional to the differential pressure across the cyclone and thus is also a power function of the flow rate through the cyclone.

It can be seen by comparison with the cyclone of the first embodiment and shown in FIG. 1 that by the design of the spring 17 so as to have a negative rate, this cyclone may be made to operate in the same manner. The coefficient R' is greater than R and assists in ensuring that the cyclone does not stop in an intermediate position.

Figure 3:
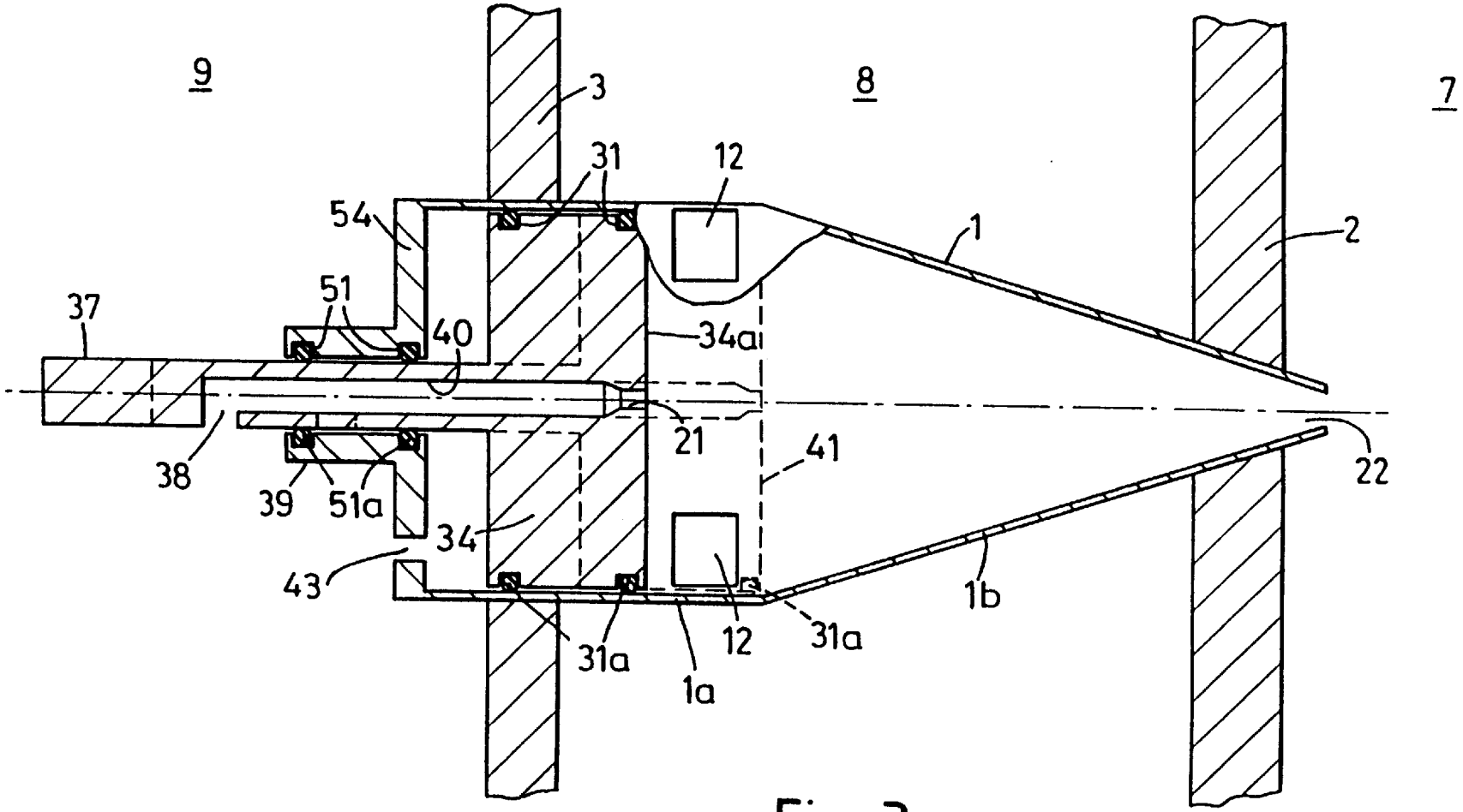

A third embodiment of the invention, in which the main body of the cyclone 1 remains stationary, is shown in FIG. 3. For clarity the outer walls of the pressure vessel 10 have been omitted. As in the first and second embodiment the pressure vessel has two dividing walls in the form of tubeplates 2 and 3 dividing the vessel into three chambers 7, 8 and 9. The pressure vessel contains many cyclones, only one of which is shown. The cyclone shown has an underflow port 22, an overflow port 21 and two inlet ports 12.

The end wall of the cyclone 1 adjacent to the inlet ports 12 is formed by one face of a head piston 34. A tube 37 is attached to the rear face 34*b* of this piston. In the centre of the head piston is the overflow port 21 through which fluid is able to pass into the overflow chamber of the vessel via an internal channel 40 and exit port 38 in the tube (similar to the construction shown in FIG. 2). The head piston is sealed to the cyclone body by means of spaced-apart O-ring seals 31*a* in peripheral grooves 31 where the area of the head piston is $A_p$ and the tube of external area $A_t$ is sealed in the boss 39 by means of spaced-apart O-ring seals 51*a* in grooves 51. The rear face of the cyclone is closed with a disc 54 within which there is an aperture 43 whereby fluid under pressure $P_a$ may be introduced into the cavity between the two seals. The head piston 34 is able to move axially within certain limits created by mechanical stops (not shown) and the sealing means is effective throughout this motion. The head piston is drawn in solid lines at one end of its motion (left-hand in FIG. 3) where it provides a minimum obstruction to fluid flowing into the cyclone via the inlet ports 12 and where flow through the port 38 is not obstructed.

The head piston is shown in dashed lines 41 at the other end of its motion (right-hand end as shown) where it covers the inlet ports 12, preventing fluid flowing into the cyclone. When the head piston is moved into this right-hand, closed position, the passage of fluid from the overflow port to the overflow chamber is prevented by the port 38 from which the fluid exits via the channel 40 from the overflow outlet port 21 being obscured by the sleeve 39.

It can be shown that the pressure force due to the differential pressures generated by the flow rate through the cyclone $F_1$ pushing the head piston 34 to the left as shown in FIG. 3 is:

$$F_1 = \left(P_i - \frac{(P_i - P_o)}{R'}\right)A_p - P_o A_t \tag{22}$$

where $$R = \frac{(P_i - P_o)}{(P_i - P_u)} \tag{23}$$

and where R' lies between R and positive infinity (which occurs when $P_u = P_i$) for the reasons described in relation to the second embodiment shown in FIG. 2 above.

It can also be shown that the pressure force $F_r$ pushing the cyclone to the right as shown in FIG. 3 that is generated by the applied pressure $P_a$ is $$F_r = P_a(A_p - A_t) \tag{24}$$

Frictional forces $F_f$ generated at any point of contact of the parts, and by the sealing means also resist the motion of the head piston and tube.

By control of the pressure $P_a$ it is thus possible to cause $F_r$ to be less than $Fl - F_f$ and thus cause the head piston to move to the left, opening the inlet and overflow ports. It is also possible to cause $F_r$ to be greater than $Fl + F_f$ and thus cause the head piston to move to the right, closing the inlet and overflow ports.

Thus the switching of the cyclone between the open and closed positions may be controlled by varying the applied controlling pressure from a high pressure to a low pressure or vice versa. In a vessel containing many cyclones as shown in FIG. 3, the cyclones may be switched in groups of any desired size by connecting all cyclones in a group to the same controlling pressure source and thereby reducing the number of controlling pressure sources that are required.

By adjusting the areas of the head piston $A_p$ and the tube $A_t$ it is possible to make a number of cyclones such that when these cyclones are operated with the same differential pressure across them, they will each have a different value of the applied controlling pressure for which they switch between the open and closed positions. By connecting these cyclones to a single controlling pressure source, it is thus possible to vary the number of cyclones that have switched to a certain state by a continuous (or stepwise) variation of that controlling pressure. This can reduce the number of controlling pressure sources for a vessel containing many cyclones as shown in FIG. 3 to one.

Figure 4:
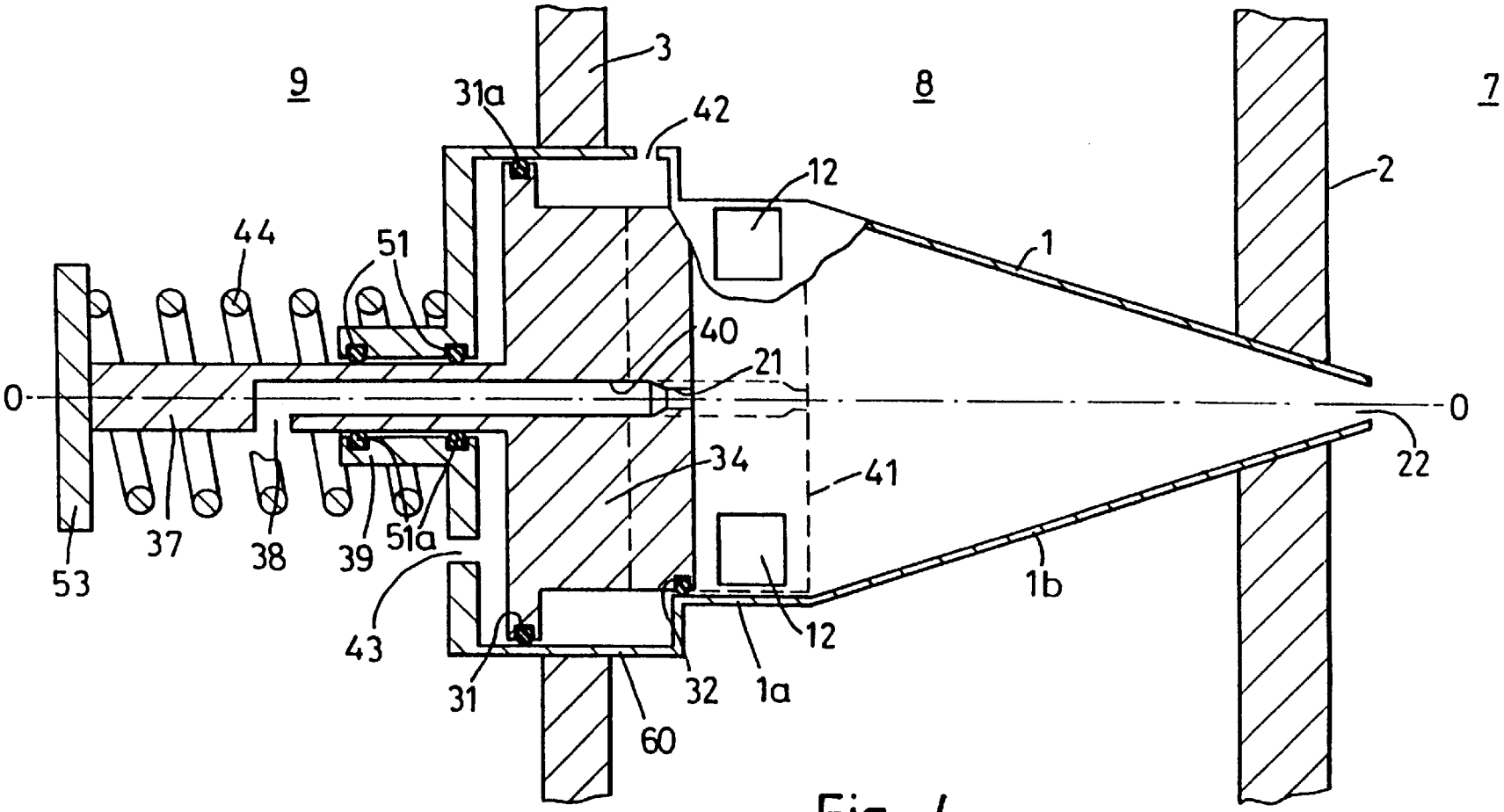

The fourth embodiment of the invention in which the main body of each cyclone 1 remains stationary, is shown in FIG. 4. For clarity the outer walls of the pressure vessel 10 have been omitted. As in the previous embodiment the vessel has two dividing walls in the form of tubeplates 2 and 3 dividing the vessel into three chambers 7, 8 and 9. The cyclone has an underflow port 22, an overflow port 21 and two inlet ports 12.

In this embodiment a head piston is provided with a rear flange 31 which moves within an enlarged section 60 at the rear of the cyclone 1. A peripheral groove 31*a* containing a O-ring seal seals the flange to the interior surface of the enlarged section 60 of the cyclone. A port 42 provides communication between the enlarged section of the cyclone and the inlet portion 8 of the pressure vessel. The head piston is also provided with a peripheral groove 32 containing an O-ring seal adjacent the front face which forms the rear wall of the cyclone.

The piston is provided with a rearwardly-extending tube 37 at the rear end of which is provided a flange 53, the plane of the flange being perpendicular to the axis O—O of the cyclone. A helical spring 44 is positioned between the flange 53 and the rear enclosing wall of the cyclone, the wall having a vent 43. The spring 44 assists the motion of the head piston when the pressure forces alone may not be sufficient to overcome the frictional forces resisting the motion of the head cylinder as described in relation to the third embodiment shown in FIG. 3. In addition, the spring may cause the cyclone, in the absence of a controlling pressure, or a fluid flow through it, to adopt the open (or closed) position i.e. to "fail closed" or "fail open".

The embodiment shown in FIG. 4 also incorporates a stepped head cylinder similar to that described in relation to the second embodiment shown in FIG. 2 so that a pressure force can be generated when $P_u$ is equal to or nearly equal to $P_0$ e.g. as a solid/liquid cyclone is normally operated.

Figure 5:
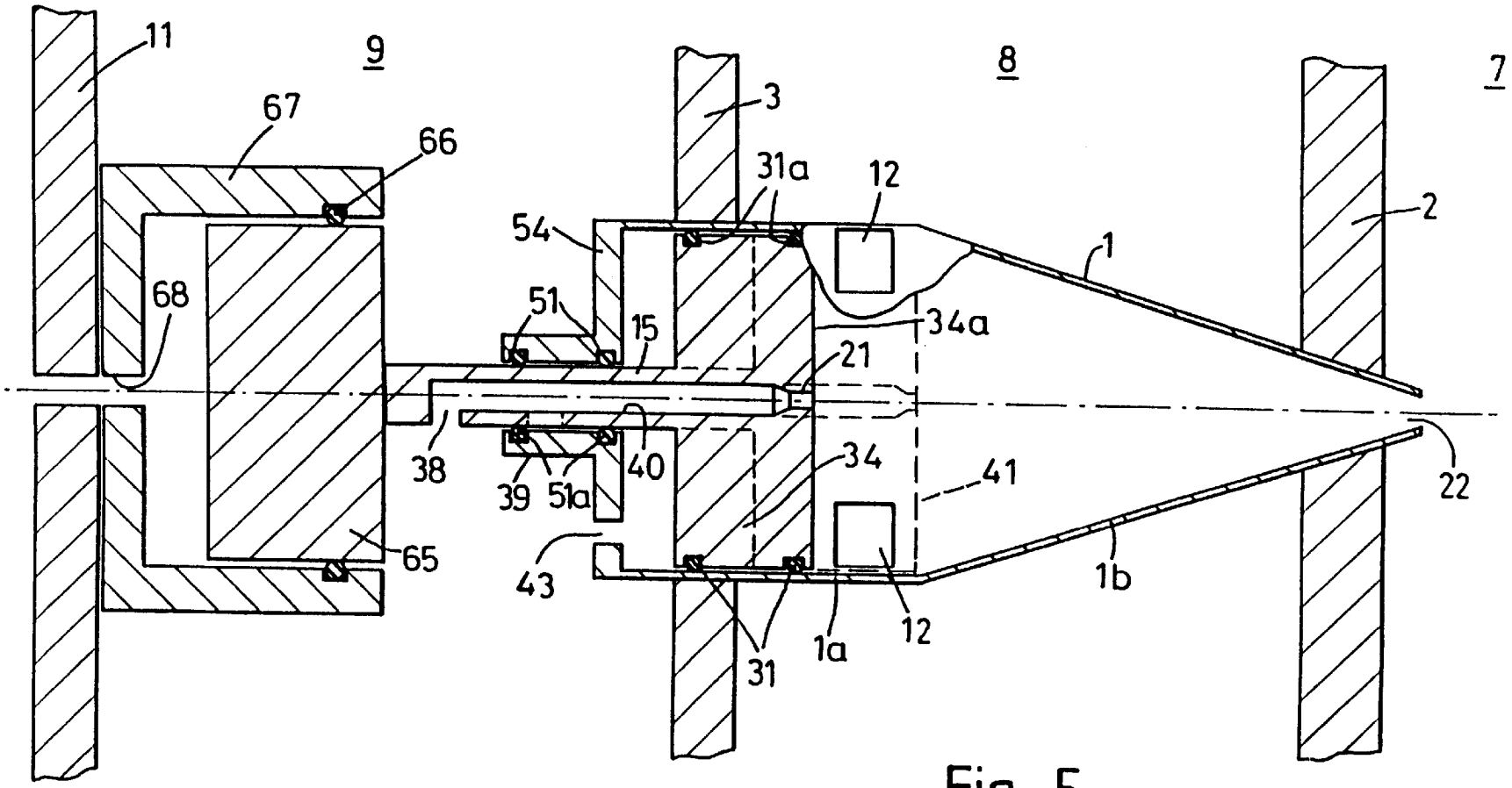

The fifth embodiment of the invention is shown in FIG. 5 and is similar to the third embodiment. Thus it will not be described again in full detail.

In this fifth embodiment the movement of the head piston 34 is controlled by a non-integral piston 65 sealingly housed by a seal 66 in a cylinder 67 attached to the end wall 11 of the chamber 10 nearer to the tube plate 3. The cylinder is capable of being pressurised by fluid fed into an aperture 68 in the end wall. (Port 43 is a vent port in this embodiment, and not a port for controlling pressure as previously described).

In use to move the head cylinder to the right (as shown in FIG. 5) pressurising fluid is fed through the aperture 68 in the cylinder 67 causing the piston 65 to move to the right. The piston presses against the left-hand end of the rod 15 further from the head portion 34 causing it to move to the right and cover the inlet ports 12. Thus the head piston 34 is caused to move independently of the pressure difference between the inlet chamber 8 and overflow chamber 9. However because the piston 65 is not connected to the rod 15, when the pressure applied to the piston 65 or by pressurising fluid in the cylinder 67 is removed, the head piston 34, the rod 15 and the piston 65 move to the left when the pressure in inlet chamber 8 is greater than that in overflow chamber 9.

As a modification a spring may be provided between the disc 54 and the piston 65 for the same purpose as described in relation to the embodiment shown in FIG. 4.

Figure 6:
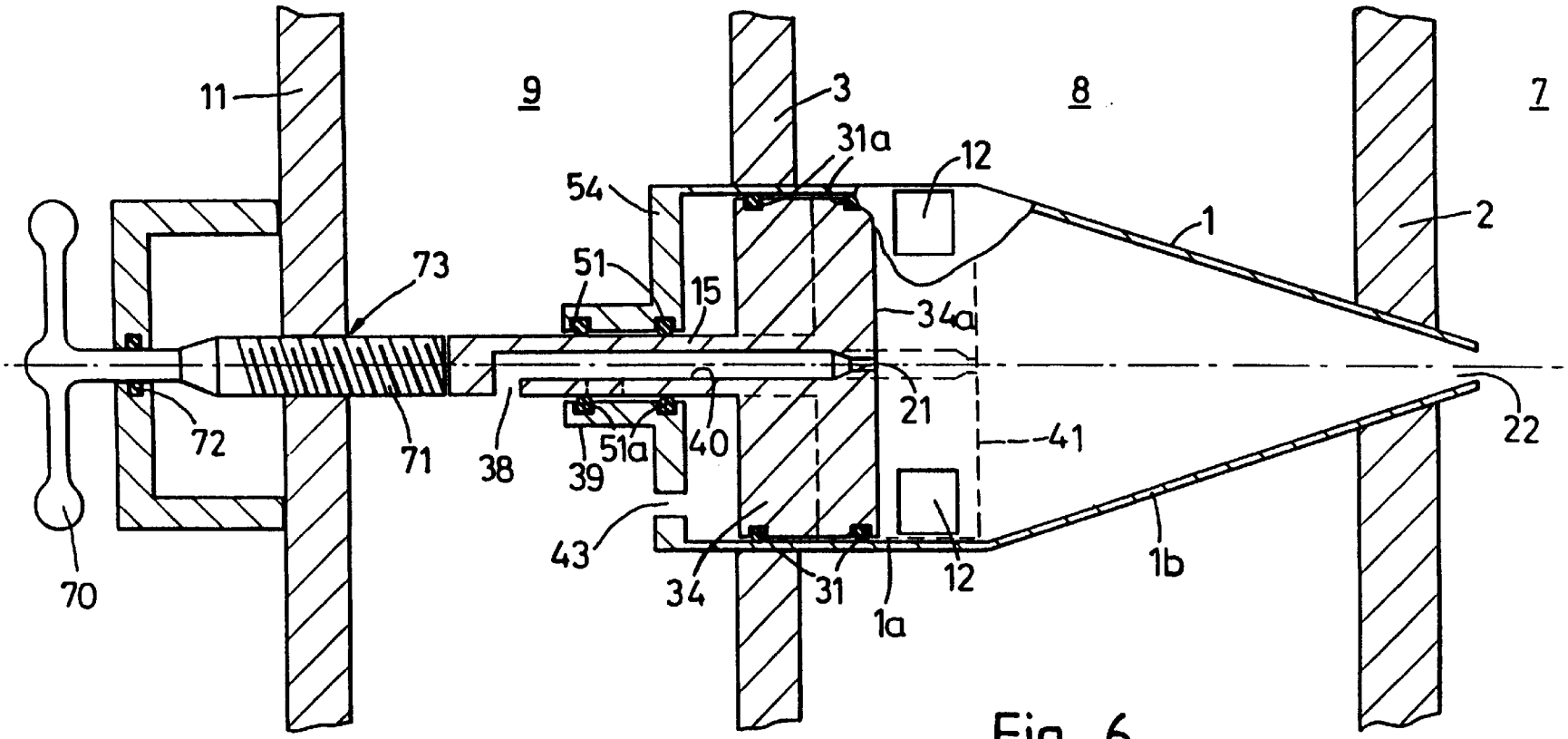

The sixth embodiment of the invention is shown in FIG. 6 and is similar to the fifth embodiment. Thus it will not be described in full detail.

In this sixth embodiment the movement of the head piston 34 is controlled by a rotatable actuator 70 attached to a screw 71 passing through a seal 72 and a screw-threaded hole 73 in the end wall 11. The end of the screw within the overflow chamber 9 presses against or is connected to the left-hand end of the rod 15.

In use to move the head piston 34 to the right and close the inlet ports 12 the actuator is operated to rotate the screw 71 and thus push the rod 15 and head piston 34 to the right. The rod 15 and head piston 34 are only able to move to the left when the screw 71 is rotated in the opposite sense, either being pulled by the screw if connected to the rod, or under the pressure differential between the inlet chamber 8 and overflow chamber 9 if not connected.

I claim:

1. Separation apparatus for separating a mixture of materials which at least behaves as a fluid, comprising:

(a) a vessel through which said mixture flows, said mixture having a characteristic comprising at least one of a pressure of said mixture and a flowrate of said mixture in said vessel (b) a plurality of cyclones in said vessel, said cyclones arranged into at least two groups, said two groups including at least one control group and at least one other group, each cyclone having an inlet port, an overflow port and an underflow port, at least one of said plurality of cyclones arranged in at least one control group; and (c) each cyclone in said at least one control group including at least one valve for controlling flow through at least two of said inlet port, said overflow port and said underflow port, said valve controlling flow between an open state and a closed state without any position intermediate said open and closed states, (d) wherein valves in cyclones of one of said at least one group are responsive to said characteristic being at a first level at which said valve moves to said open state, and a second level, less than said first level, at which said valve moves to said closed state, the difference between said first level and said second level is sufficiently large that when one of said levels is reached by said characteristic and valves in cyclones of one of said at least one group change from one state to another state, any resultant change in said characteristic is insufficient to reach the other of said levels.

2. Separation apparatus according to claim 1, wherein said at least one control group comprises two control groups wherein said characteristic is pressure caused by a difference in pressure between pressure at the inlet port and pressure at at least one of the underflow port and overflow port, the pressure difference which causes valve movement in one of said groups being different from the pressure difference which causes switching of a cyclone in another of said groups.

3. Separation apparatus according to claim 1, wherein said valve is comprised of at least part of the cyclone and valve movement is in a direction parallel to an axis of said cyclone between open and closed positions of at least one of the cyclone inlet port, overflow port and underflow port.

4. Separation apparatus according to claim 1 further including a check valve connected to one of the overflow port and the undertow port.

5. Separation apparatus according to claim 1, wherein each of said valves further including a spring device having a negative spring rate capable of producing a force in opposition to pressure and friction forces in the cyclone to ensure that the cyclone inlet is in one of said two states.

6. Separation apparatus according to claim 1, further including means for applying a controlling pressure to said valves, movement of said valves being controlled by said controlling pressure.

7. Separation apparatus according to claim 6, said means for applying comprising a control system which produces one of a high and a low controlling pressure sufficient to cause the closure of one of the inlet, overflow outlet and underflow outlet of the cyclone at a low cyclone differential pressure and the opening of one of the inlet, overflow outlet and underflow outlet of the cyclone at a high cyclone differential pressure.

8. Separation apparatus according to claim 6 wherein the means for applying produces an infinitely variable controlling pressure in response to the cyclone differential pressure.

9. Separation apparatus according to claim 8, wherein said at least one control group comprises at least two control groups, and the means for applying a controlling pressure in conjunction with said cyclones causes said valves of the two control groups to switch between the open and closed states at different controlling pressures.

10. Separation apparatus according to claim 7 wherein each group of cyclones has associated therewith the control system producing sufficient controlling pressure to operate each cyclone in that group.

11. Separation apparatus according to claim 7 further including a flow measuring system to generate an input signal, said means for applying is responsive to said input signal.

12. Separation apparatus according to claim 11 wherein the input signal represents the desired flow rate through the apparatus.

13. Separation apparatus according to claim 7 further including a control device for controlling the properties of the materials processed by the cyclone and which is used to generate an input signal for the control system, which signal controls the cyclone operation.

14. Separation apparatus according to claim 1 further comprising a plurality of vessels connected together to operate in parallel.

15. Separation apparatus according to claim 1, wherein said mixture comprises a mixture of liquids, said liquids having different densities.

16. Separation apparatus according to claim 1, wherein said at least one group comprises at least first and second groups, and said at least first and second groups have said valves where said valves of said first group open in response to said characteristic being at a first level higher than the characteristic first level of said second group.

17. Separation apparatus according to claim 1, wherein said characteristic comprises pressure of said mixture, said pressure comprising the difference in pressure between at least two of said inlet port, said overflow port and said underflow port.

18. Separation apparatus according to claim 1, wherein said valve for controlling flow controls flow through only two ports.

19. Separation apparatus according to claim 18, wherein said two ports are said inlet port and said overflow port.

20. Separation apparatus according to claim 1, wherein said at least one cyclone in said at least one control group comprises a plurality of cyclones.

21. Separation apparatus according to claim 1, wherein said plurality of cyclones includes at least one uncontrolled cyclone without any valve, said uncontrolled cyclone in combination with said at least one control group said at least one control group comprising a plurality of cyclones.

* * * * *